US005870916A

United States Patent [19]

Drigani et al.

[11] Patent Number: 5,870,916

[45] Date of Patent: Feb. 16, 1999

[54] DEVICE FOR THE CROSSED DISPLACEMENT OF ROLLING ROLLS

[75] Inventors: Fausto Drigani, Zugliano/Pozzuolo del Friuli; Giacinto Dal Pan, Cellatica, both of Italy

[73] Assignee: Danieli & C. Officine Meccaniche SpA, Buttrio, Italy

[21] Appl. No.: 878,131

[22] Filed: Jun. 18, 1997

[30] Foreign Application Priority Data

Jun. 24, 1996 [IT] Italy ..... UD96A0109

[51] Int. Cl.[6] ..... B21B 31/00; B21B 31/07; B21B 31/18

[52] U.S. Cl. ..... 72/237; 72/247

[58] Field of Search ..... 72/237, 240, 241.2, 72/245, 247, 248, 241.4, 241.8

[56] References Cited

U.S. PATENT DOCUMENTS

| | | | |
|---|---|---|---|
| 1,971,982 | 8/1934 | Holeton . | |
| 2,965,920 | 12/1960 | Whittum . | |
| 3,197,986 | 8/1965 | Freedman . | |
| 3,631,696 | 8/1965 | Williams . | |
| 4,727,741 | 3/1988 | Ushifusa et al. | 72/237 |

FOREIGN PATENT DOCUMENTS

| | | | |
|---|---|---|---|
| 721951 | 6/1942 | Germany . | |
| 405269510-A | 10/1993 | Japan | 72/245 |
| 1017805 | 1/1966 | United Kingdom . | |

*Primary Examiner*—Joseph J. Hail, III
*Assistant Examiner*—Rodney Butler
*Attorney, Agent, or Firm*—Antonelli, Terry, Stout & Kraus, LLP

[57] ABSTRACT

Device for the crossed displacement of rolling rolls (10), whether they be working rolls and/or back-up rolls, in a rolling mill stand (11) for plate and/or strip, the rolls (10) being supported at the ends by respective supporting chocks (12) associated to stationary housing (13), the chocks including an inlet side and an outlet side, the chocks (12) on one roll (10) being associated with the device to position the rolls (10) in a crossed position, cooperating with at least one of the inlet and outlet sides of the chocks (12) of at least one roll (10), there also being a front cam (16), whose axis lies on a substantially parallel plane to the rolling plane, associated with drive shafts (15), the front cam (16) comprising at least two substantially cylindrical coaxial elements (17, 18), one connected to the drive shaft (15) and the other cooperating with the chock (12), the front cam (16) including front surfaces of reciprocal connection (19, 20) defining inclined radial sliding planes and at least two principles, the rotary movement imparted to the front cam (16) being functional to the lateral displacement of the chock (12).

5 Claims, 2 Drawing Sheets

DEVICE FOR THE CROSSED DISPLACEMENT OF ROLLING ROLLS

BACKGROUND OF THE INVENTION

This invention concerns a device for the crossed displacement of rolling rolls, whether they be working rolls and/or back-up rolls.

To be more exact, the invention is applied in cooperation with the upper and lower rolling blocks of a four-high rolling mill stand for plate and/or strip in order to permit a crossed and coordinated displacement of the working rolls and/or back-up rolls.

The state of the art covers four-high rolling mill stands for plate and/or strip which include opposed upper and lower working rolls which define the rolling plane and are fitted to the relative chocks located on one side and the other of the rolling mill stand.

Each working roll is associated with a relative back-up roll, the function of which is to limit the bends produced in the working roll during rolling, thus allowing very high rolling pressures to be used.

The state of the art covers the need to induce in the rolls a displacement in the rolling plane which causes a reciprocal crossed positioning of the rolls even though at very limited angles.

In the state of the art, this crossing movement is generally carried out by using two different techniques.

According to a first technique, traversing movements are imparted in a suitable direction to all the chocks supporting the rolls.

In order to achieve the crossed positioning of the rolls, each chock positioned at one end of a roll, for example a working roll, receives a traversing movement in the opposite direction to the movement imparted to the opposite chock of the same working roll and to the movement imparted to the chock at the same end of the opposed working roll.

By using this technique, the vertical projection of the point of intersection of the axes of the rolls remains unchanged for any angle imparted to the axes of the rolls.

According to another displacement technique, by displacing only the opposed chocks located on one side of the roll, while the chocks located on the opposite side are kept stationary, the position of the vertical projection of the point of crossover of the axes of the rolls is varied.

In the state of the art, a plurality of systems to displace the chocks have been proposed, for example with gear systems, screw-threaded systems, jack systems and others.

All these systems however have been found unsatisfactory with regard to accuracy of positioning, coordination of the movements, simplicity of embodiment and application, installation costs and other reasons, among which are the considerable power required, the considerable bending caused, the incorrect functioning of the bearings, etc.

Moreover, these systems known to the state of the art involve very long and laborious inspection and/or maintenance times, both because of their complex embodiments and also because of their positioning, as access is only possible with difficulty, or the maintenance/repair workers can only reach them after preliminary operations of at least partial dismantling of the rolling mill stand, carried out when the plant has been stopped, with all the technical and economic problems which that causes.

U.S. Pat. No. 1,971,982 provides to obtain the lateral movement and positioning of the chock with a pair of male-female threaded connections.

The connections have the disadvantage that they require a considerable specific pressure, a high number of revolutions to be imparted to one or the other of the components in order to obtain the desired displacement, a considerable precision of connection and a considerable axial length.

U.S. Pat. No. 3,197,986 of 1961 provides for front cam systems to adjust the working pressure and therefore the space between the working rolls. It is a dynamic adjustment system associated with the thickness of the rolled strip and to the maintenance of the desired value of thickness.

SUMMARY OF THE INVENTION

The present applicants have designed, tested and embodied this invention to overcome the shortcomings of the state of the art and to provide further advantages.

The purpose of this invention is to provide a device for the crossed displacement of rolling rolls which is simple in its construction and functioning, and is able to displace the rolling rolls in a precise, controlled and coordinated manner.

The device according to the invention makes it possible to obtain the crossed positioning of the rolls of a rolling mill stand for the desired time, imparting to a first end of one roll traversing movements in the opposite direction to those imparted to the opposite end of the same roll and in the opposite direction to those imparted to the corresponding ends of the opposed working roll.

To this purpose, the device according to the invention acts, on a plane substantially parallel to the rolling plane, by displacing one end of a working roll in a particular direction and at the same time by displacing the opposite side of the same end with a coordinated movement in the opposite direction.

The device according to the invention comprises front cam means arranged in a position of substantial side contact with a relative chock, and these front cam means, when they are made to rotate, impart to the chock the desired movements of lateral displacement.

According to the invention, the front cam means have at least two principles (starting or lower points).

According to a variant, the plane of inclination on which the principles of the front cam means lie is a plane which gives a stable stop position and therefore does not create an inverse rotation component which can modify the position reached.

The front cam means are governed by the appropriate drive means which determine the direction of the movements of lateral displacement imparted by the front cam means to the ends of the rolls.

According to a variant of the invention, the front cam means are present on both fronts of the rolling mill stand and act on both ends of the rolling rolls.

According to another variant, the front cam means are present on only one front of the rolling mill stand and act on only one end of the rolls.

BRIEF DESCRIPTION OF THE DRAWINGS

The attached figures are given as a non-restrictive example and show some preferred solutions of the invention as follows.

DETAILED DESCRIPTION OF THE PREFERRED EMBODIMENTS

Figure 1:
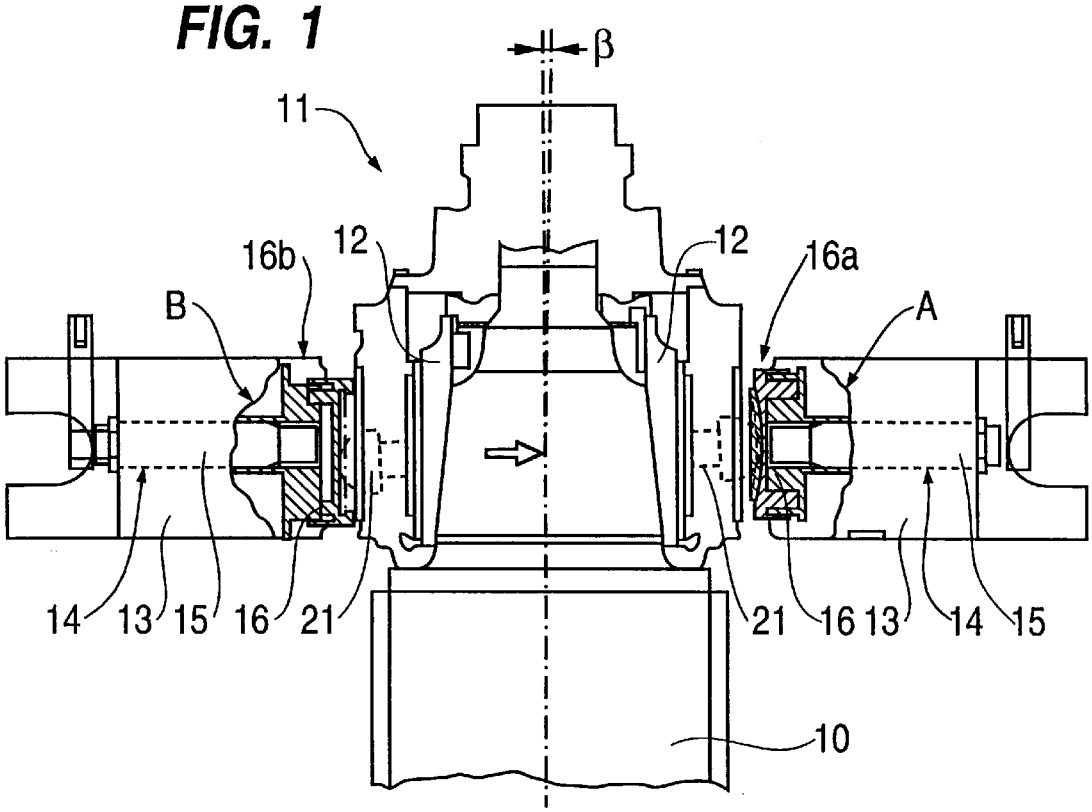
FIG. 1 shows in partial section a part of a rolling mill stand using the device according to the invention.

The roll 10 of a rolling mill stand 11 for plate and/or strip, partly shown in FIG. 1, has its ends associated with respective supporting chocks 12 housed in the space delimited at the inner part by a stationary housing 13.

The stationary housing 13 has through holes 14 in which are housed the drive shafts 15 of front cam means 16 placed in a position of direct cooperation with the relative chock 12.

Figure 2:
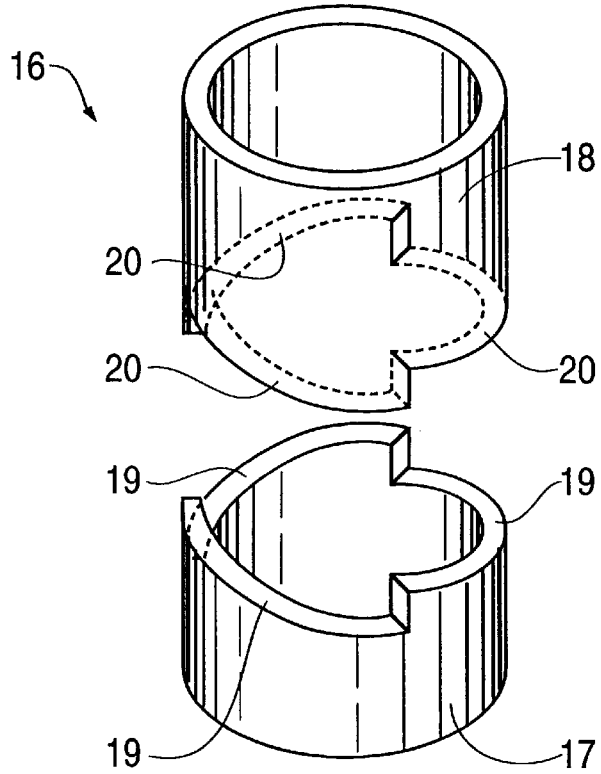
FIG. 2 is a partial view of a detail of the device according to the invention.
Figure 3:
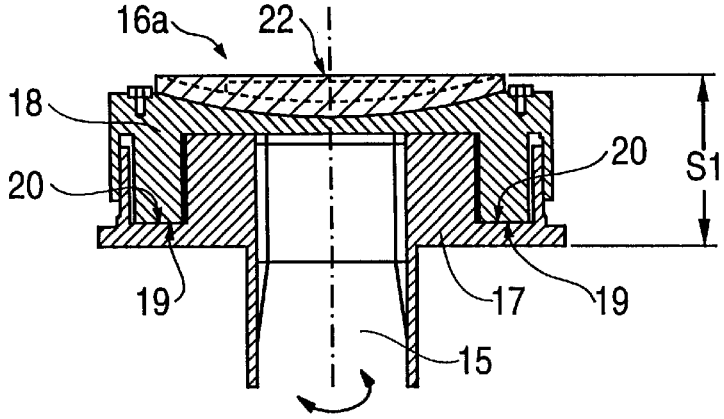
FIG. 3 shows in a longitudinal section the enlarged detail A from FIG. 1.
Figure 4:
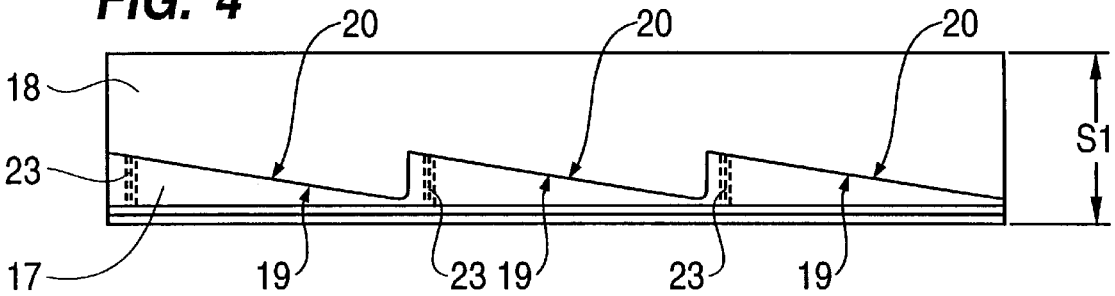
FIG. 4 shows in diagram form the longitudinal extension of FIG. 3.
Figure 5:
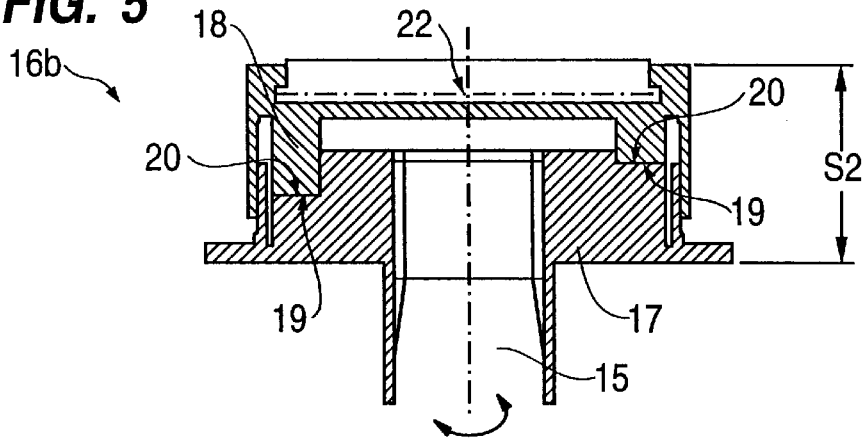
FIG. 5 shows in a longitudinal section the enlarged detail B from FIG. 1.
Figure 6:
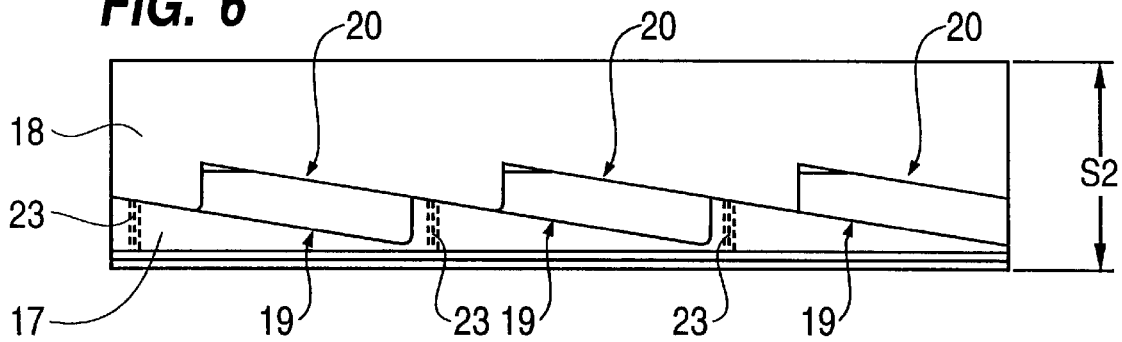
FIG. 6 shows in diagram form the longitudinal extension of FIG. 5.

The front cam means 16, as shown diagrammatically in FIG. 2, are substantially composed of a first substantially cylindrical element 17 solidly associated with the relative drive shaft 15, cooperating with a mating, substantially cylindrical element 18 suitably associated, either directly or by means of intermediate elements to transmit the movement, with the relative chock 12 of the roll 10.

The cylindrical elements 17 and 18 have front surfaces of reciprocal contact, respectively 19 and 20, defining mating inclined planes with a radial development which cooperate with each other.

According to a variant, between the contact surfaces 19 and 20 there are means suitable to reduce the friction such as bearings or rolls, oil pads, foils with low friction coefficient, etc.

The rotary movements imparted by drive means, not shown here, to the shaft 15 and thence to the cylindrical element 17, cause a sliding movement of the inclined plane surfaces 19 of the cylindrical element 17 on the mating inclined plane surfaces 20 of the cylindrical element 18.

This causes rectilinear movements of axial displacement in the cylindrical element 18 in one direction or the other according to the direction of movement of the rotation of the shaft 15.

In other words, the front cam means 16 progressively assume a plurality of positions which vary from a first working position 16*a*, where the front cam means 16 has an overall minimum width S1, to a second working position 16*b*, where the front cam means 16 has an overall maximum width S2.

In this way, as the cylindrical element 17 is free to rotate but solidly fixed to the stationary housing 13, the rectilinear movements of axial displacement of the cylindrical elements 18 are transmitted directly to the chocks 12 with which the cylindrical elements 18 are associated.

In this case, these movements are transmitted by means of spherical or cylindrical joints 21 cooperating with mating surfaces 22 on the cylindrical element 18.

The cylindrical element 18 also has end of travel means 23 which prevent the cylindrical element 17 from carrying out rotary movements above the desired values.

In the case shown in FIG. 1, the front cam means 16 have been adjusted, by means of the opposed action of the respective shafts 15, in such a way as to have, on the opposite sides of the chock 12, respectively a first working position 16*a* and a second working position 16*b* actuating a movement in the roll 10 according to the desired angle β.

The drive shafts 15 are advantageously governed by a control system in order to obtain coordinated and controlled displacements on opposite sides of the chock 12.

According to a preferred solution of the invention, the front cam means 16 are included on both fronts of the rolling mill stand 11.

According to a variant, the front cam means 16 are included on only one front of the rolling mill stand 11.

We claim:

1. A rolling mill stand, comprising:

a stationary housing having respective spaces therein;

a plurality of rolling rolls, each of which is supported at its ends by respective supporting chocks housed in the respective spaces in the stationary housing; and at least one cam provided between the stationary housing and at least one chock of at least one rolling roll, the cam comprising a first substantially cylindrical element connected to a drive shaft and a second substantially cylindrical element, coaxial with the first substantially cylindrical element, operably associated with the at least one chock, the first and second substantially cylindrical elements having reciprocally connecting front surfaces defining inclined radial sliding planes, whereby rotary movement of the first substantially cylindrical element by the drive shaft imparts an axial displacement in the second substantially cylindrical element so as to cause a lateral displacement of the at least one chock.

2. Rolling mill stand as in claim 1, in which the first and second substantially cylindrical elements have a first limit position of maximum compression in which the cam has a minimum width ("S1") and a second limit position of maximum extension in which the cam has a maximum width ("S2").

3. Rolling mill stand as in claim 1, in which between the second substantially cylindrical element of the at least one cam and the at least one chock there is provided movement transmission means with a substantially spherical or cylindrical development.

4. Rolling mill stand as in claim 1, in which the reciprocally connecting surfaces have end of travel means.

5. Rolling mill stand as in claim 1, in which between the reciprocally connecting front surfaces there are friction reducing means.

* * * * *